US006403039B1

(12) United States Patent
Brück et al.

(10) Patent No.: US 6,403,039 B1
(45) Date of Patent: Jun. 11, 2002

(54) CATALYTIC CONVERTER FOR A SMALL ENGINE AND METHOD FOR MANUFACTURING THE SAME

(75) Inventors: Rolf Brück; Wolfgang Maus, both of Bergisch-Gladbach (DE)

(73) Assignee: Emitec Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 09/309,181

(22) Filed: May 10, 1999

Related U.S. Application Data

(63) Continuation of application No. PCT/EP97/06044, filed on Nov. 3, 1997.

(30) Foreign Application Priority Data

Nov. 8, 1996 (DE) ..... 196 46 242

(51) Int. Cl.[7] ..... F01N 3/28; B01D 53/94

(52) U.S. Cl. ..... 422/180; 422/177; 181/158; 60/299

(58) Field of Search ..... 422/171, 177, 422/180, 174; 60/299, 300; 181/158, 182; 502/527.18–527.19

(56) References Cited

U.S. PATENT DOCUMENTS

| | | | | |
|---|---|---|---|---|
| 4,094,645 A | * | 6/1978 | Bailey | 60/299 |
| 4,867,270 A | * | 9/1989 | Wissmann et al. | 181/231 |
| 4,890,690 A | * | 1/1990 | Fischer et al. | 60/299 |
| 4,894,987 A | * | 1/1990 | Harwood et al. | 422/180 |
| 5,338,903 A | * | 8/1994 | Winberg | 181/231 |
| 5,548,955 A | * | 8/1996 | Sandefur et al. | 422/180 |
| 6,109,386 A | * | 8/2000 | Maus et al. | 422/180 |

FOREIGN PATENT DOCUMENTS

| | | |
|---|---|---|
| DE | 38 29 668 A1 | 6/1989 |
| DE | 42 43 079 C2 | 9/1994 |
| EP | 0 218 062 | 4/1987 |
| EP | 0 470 113 B1 | 2/1992 |
| FR | 79 31437 | 7/1980 |

OTHER PUBLICATIONS

Patent Abstracts of Japan, 04122418 (Takashi), dated Apr. 22, 1992, "Catalyst converter for purification of exhaust gas automobile".

* cited by examiner

*Primary Examiner*—Hien Tran
(74) *Attorney, Agent, or Firm*—Herbert L. Lerner; Laurence A. Greenberg; Werner H. Stemer

(57) ABSTRACT

A catalytic converter for a small engine and a method for manufacturing the same include a honeycomb body coated with catalytically active material and made from at least partly structured layers of sheet metal with channels for the passage of exhaust gas. In order to reduce manufacturing costs, the honeycomb body is placed in a silencer housing disposed in the proximity of the engine, in such a way that at least a predominant portion of exhaust gas of the small engine has to flow through the honeycomb body. The honeycomb body is a layered, wound or folded stack of sheet metal layers, which is squeezed into the silencer housing, plastically deforming at least 10% and preferably 20 to 30% of the channels, so that it completely fills at least a partial volume of the housing. Due to the considerable plastic distortion of a part of the channels, there is also a high degree of elastic deformation in the rest of the honeycomb body, which also ensures the stability of the honeycomb body, even under varying thermal stresses.

11 Claims, 2 Drawing Sheets

CATALYTIC CONVERTER FOR A SMALL ENGINE AND METHOD FOR MANUFACTURING THE SAME

CROSS-REFERENCE TO RELATED APPLICATION

This application is a continuation of copending International Application No. PCT/EP97/06044, filed Nov. 3, 1997, which designated the United States.

BACKGROUND OF THE INVENTION

FIELD OF THE INVENTION

The present invention relates to a catalytic converter for a small engine, wherein a honeycomb body coated with a catalytically active material is disposed in a silencer or sound deadening housing in the proximity of the engine. The invention also relates to a method for manufacturing the catalytic converter.

As a result of increasing environmental awareness, and stricter emission regulations in many countries, the need has grown to carry out catalytic cleaning of exhaust gas, not only in the case of automotive vehicles, but also for small engines. In the following text, small engines are considered to be engines with a capacity of less than 250 cc, in particular less than 50 cc. Such engines are found in particular in lawn mowers, motorized saws, portable generator units, two-wheelers, and like applications. In particular with motorized saws, lawn mowers and other garden machinery, the person operating the machinery is often directly within range of the exhaust gas of the small engine for a long period of time, which is why catalytic cleaning of exhaust gas is particularly important.

German Published, Non-Prosecuted Patent Application DE 38 29 668 A1, corresponding to U.S. Pat. No. 4,867,270, already provides an example of an exhaust silencer for two-stroke engines, which includes in its interior a catalytic converter for cleaning exhaust gas.

A metallic catalytic converter carrier body is also known from European Patent 0 470 113 B1, which is suitable in particular for fitting into a separating wall of a silencer housing.

The configurations described for catalytic cleaning of the exhaust gas of small engines require specially manufactured honeycomb bodies, the production, catalytic coating and installation of which require a relatively large number of working steps and are therefore relatively expensive as compared to the small engine itself and an associated machine. In order to arrive at a wider distribution of the catalytic cleaning of exhaust gas for small engines, it is necessary to drastically reduce the costs of such exhaust gas cleaning devices.

SUMMARY OF THE INVENTION

It is accordingly an object of the invention to provide a catalytic converter for a small engine and a method for manufacturing the same, which overcome the hereinafore-mentioned disadvantages of the heretofore-known devices and methods of this general type and in which the catalytic converter can be produced very inexpensively, requires as few structural changes as possible to already existing small engines and to their exhaust systems and nevertheless can catalytically remove a significant proportion of pollutants from exhaust gas.

With the foregoing and other objects in view there is provided, in accordance with the invention, a catalytic converter, comprising a silencer housing disposed in proximity to a small engine emitting exhaust gas; a honeycomb body disposed in the silencer housing for causing at least a predominant portion of the exhaust gas of the small engine to flow through the honeycomb body; the honeycomb body coated with catalytically active material; the honeycomb body having a layered, wound or folded stack of at least partly structured sheet metal layers defining channels for passage of the exhaust gas; and the sheet metal layers of the stack squeezed into the silencer housing for plastically deforming at least 10%, preferably 20 to 30%, of the channels and completely filling at least a partial volume of the silencer housing with the honeycomb body.

With the objects of the invention in view there is also provided a method for manufacturing a catalytic converter for a small engine, which comprises forming a stack of at least partly structured sheet metal layers defining channels for passage of an exhaust gas; and squeezing the stack into a partial volume of a silencer housing with plastic deformation of at least 10%, preferably 20 to 30%, of the channels for completely filling the partial volume.

Catalytic converters normally include honeycomb bodies in order to provide a sufficiently large surface for catalytic conversion in a part of the volume of the exhaust system. Such honeycomb bodies are manufactured in particular from layers of sheet metal, wherein at least a part of these sheet metal layers are structured, effectively producing channels which allow the passage of exhaust gas.

In the simplest case, smooth and corrugated sheet metal layers are used alternately. In the case of the present invention, however, a plurality of structures are involved, so that sheet metal layers with two different corrugations, or sheet metal layers with alternating corrugations disposed at an angle relative to one another, can also be used. In the prior art, it has been usual until now to fill the partial volume provided for a honeycomb as uniformly as possible with channels. Where possible, all of the prior art manufacturing methods avoid deforming or destroying a large number of channels during installation of the honeycomb body in an exhaust system. Although honeycomb bodies are occasionally inserted into a jacket tube or a housing by using pre-tensioning, in general the channels are not, or are only to a small extent, plastically distorted. In accordance with the solution according to the invention, that is not the path chosen for catalytic converters for small engines, in order to drastically simplify manufacturing. Silencer housings for small engines are generally provided with a larger volume than is necessary for accommodating a catalytic converter body for complete exhaust gas cleaning. Thus there is not optimum employment of the volume available, nor minimizing of a housing. It can therefore be taken into account that a part of the volume can be partially blocked by plastically deformed channels without it affecting the functioning or the exhaust gas cleaning. This lays open the possibility of simply using a layered, wound or otherwise folded stack of sheet metal layers coated with a catalytically active material, as the honeycomb body. The stack is squeezed or crushed into the silencer housing with plastic distortion of a large proportion of the cells, for example 10, 20 or up to 30%, in such a way that it completely fills at least a partial of the volume of the silencer housing.

As will be described below with reference to preferred embodiments, this method has many advantages in terms of manufacturing technology, and results in a simple but durable catalytic converter.

In general, a silencer housing for small engines is composed of two or more individual parts, in particular halfshells and a separating wall, which are combined together through the use of a simple connection procedure, for example by flanging or by welding. When they are being connected together, these housing parts can be used at the same time for shaping the honeycomb body without additional tools being needed. A stack of sheet metal layers with a greater volume than the partial volume of the silencer housing to be filled is simply laid on the location provided when the housing is joined together, and when the housing parts are joined together it is squeezed into its final position and shape. Even when 15 to 30% of the channels are plastically and/or elastically deformed by this procedure, namely on the lateral ends of the stack and in the outside edge areas, enough cells can be passed through by the gas for effective catalytic cleaning to be ensured.

In accordance with another feature of the invention, in order to prevent slipping of the honeycomb body in the silencer housing in the direction of the gas flow, the lateral ends of the stack should be retained on or in the walls of the housing.

In accordance with a further feature of the invention, in order to ensure a simple manufacturing process, the sheet metal layers are already coated with catalytically active material before being fitted into the silencer housing. Either already-coated layers are used for the whole procedure, or a pre-prepared stack of sheet metal layers is coated as a whole.

In accordance with an added feature of the invention, the considerable distortion of the channels is partly plastic and partly elastic, so that the honeycomb body remains pretensioned, which prevents loosening of the sheet metal layers under all operating conditions, in particular varying thermal stress. In general, in a catalytic converter manufactured according to the invention, the honeycomb body will be under maximum pre-tensioning as it is distorted everywhere beyond the elastic limit. This prevents relative movements between the layers of sheet metal even with decreasing elasticity occurring with increasing temperature.

At this point, it must be pointed out that for the present invention, in particular sheet metal layers with so-called transversal microstructures can also be considered, which are known in the prior art. These microstructures increase effectiveness during catalytic conversion and furthermore effect clamping of the sheet metal layers to one another, so that in particular when there is a high degree of pre-tensioning they cannot move against one another even in unfavorable conditions. This is also the case when not all of the sheet metal layers, but instead only some of them, are fixed by their ends to the silencer housing.

In accordance with an additional feature of the invention, the initial form of the stack which is to be squeezed into the silencer housing has the shape of the partial volume to be filled, and is suited to the degree of distortion anticipated for individual areas during the squeezing process wherein, nevertheless, the volume of the stack is at least 5%, preferably 10%, larger than the partial volume to be filled should be.

In accordance with yet another feature of the invention, different cross-sectional shapes for a stack can be considered, in particular rectangular, trapezoidal, oval, as well as irregular shapes in individual cases. It is also to be noted that individual sheet metal layers having ends which are curved along ends of the stack, must be longer than less highly curved layers of sheet metal, if their ends are to extend as far as the housing wall or a part seam after the squeezing process.

In accordance with a concomitant feature of the invention, in particular with silencer housings composed of at least two parts, the squeezed-together ends of the stack are clamped in a seam between these parts, in order to fix the honeycomb body as a whole. This can be carried out after squeezing the ends together both with stacks formed from individual sheet metal layers and stacks wound, folded or meander-shaped from one or more sheet metal layers. Additionally, the ends of the stack can also be incorporated in the technique used until now for joining together the silencer housing, so the fixing can, for example, be performed through the use of flanging, welding with a welded seam, or spot welding. In general the catalytically active coating on the sheet metal layers presents no hindrance, in particular with flanging, as well as with binding in a welded seam, so that no additional processing steps for their removal are necessary.

Other features which are considered as characteristic for the invention are set forth in the appended claims.

Although the invention is illustrated and described herein as embodied in a catalytic converter for a small engine and a method for manufacturing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
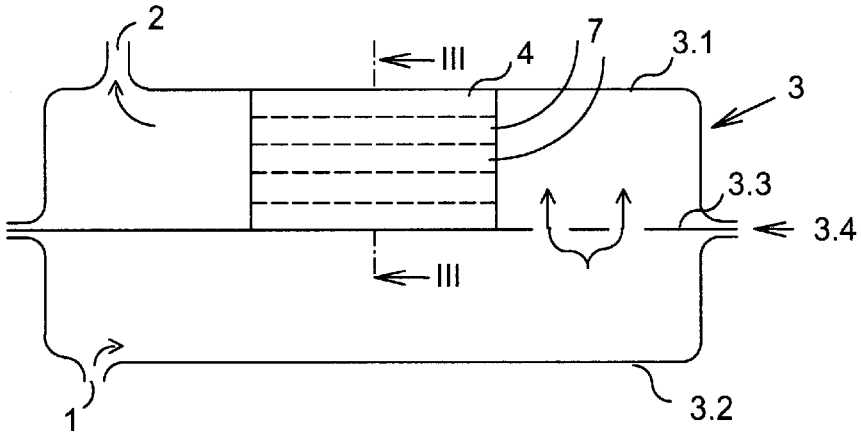
FIG. 1 is a diagrammatic, longitudinal-sectional view of a silencer housing with a location for installation of a catalytic converter.

Referring now to the figures of the drawings in detail and first, particularly, to FIG. 1 thereof, there is seen a diagrammatic, longitudinal section through a silencer or sound deadening housing 3 for a small engine. Exhaust gas enters through an exhaust gas inlet 1 and arrives in a lower part 3.2 of the silencer housing. The exhaust gas then passes through apertures in a separating wall 3.3 and arrives in an upper part 3.1 of the silencer housing. From there, the exhaust gas flows through channels 7 of a honeycomb body 4 and then arrives at an exhaust gas outlet 2. The upper part 3.1 and the lower part 3.2 of the silencer housing and the separating wall 3.3 are joined together in the area of a part seam 3.4, for example by flanging or by a welded seam.

Figure 2:
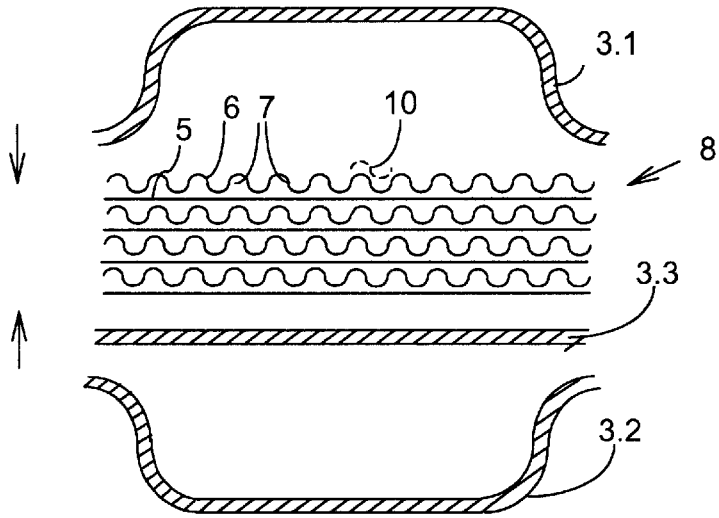
FIG. 2 is an exploded, cross-sectional view of parts of a silencer housing including a stack, shortly before assembly.

FIG. 2 is a diagrammatic cross-section showing the joining of the upper part 3.1, the lower part 3.2 and the separating wall 3.3 of the silencer housing as well as a stack 8 of sheet metal layers 5, 6, in which the joining procedure is indicated by arrows. In the present embodiment, the stack 8 is formed from alternately disposed smooth sheet metal layers 5 and corrugated sheet metal layers 6, which together form a large number of the channels 7 for exhaust gas to pass through. The sheet metal layers 5, 6 are coated with catalytically active material 10. This coating can either already be applied to the sheet metal layers 5, 6 in a continuous process prior to all of the other processing steps, or can be applied generally after the layering of the stack 8.

Figure 3:
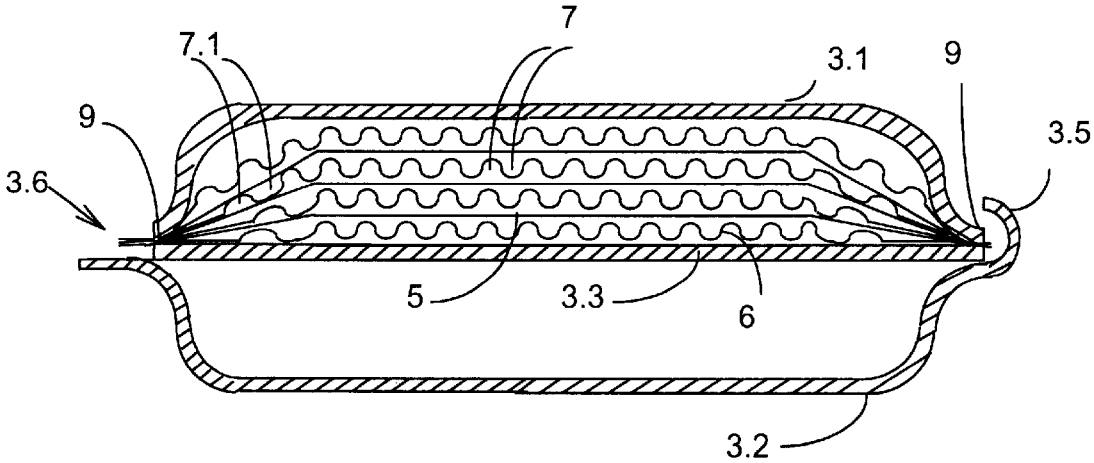
FIG. 3 is a cross-sectional view through a silencer housing after assembly, which is taken along a section line III—III of FIG. 1, in the direction of the arrows.

FIG. 3 is a cross-section taken along a line III—III in FIG. 1, showing a substantially ready-assembled silencer housing with a honeycomb body squeezed, pinched or crushed into it. It is evident that lateral ends 9 of the stack 8 which are shown as not yet deformed in FIG. 2, are now crushed and squeezed together. Additionally, numerous channels 7.1 are plastically deformed in edge areas of the honeycomb body. Despite this, enough channels which are not plastically deformed still remain to be sufficient for catalytic conversion of exhaust gas conducted through them, in particular in an internal area of the honeycomb body. These channels 7 are, however, significantly elastically distorted by the crushing forces exerted on the whole honeycomb body, to cause the whole honeycomb body to be under considerable pre-tensioning. The crushed lateral ends 9 of the sheet metal stack are clamped between the upper part 3.1 and the separating wall 3.3 of the silencer housing and can be incorporated in the usual technique for joining the silencer housing together. As is shown on the right-hand side of FIG. 3, this can be done by flanging 3.5. A welded seam 3.6 which incorporates the ends of the sheet metal layers 5, 6, the upper part 3.1, the lower part 3.2 and the separating wall 3.3, shown on the left-hand side of FIG. 3, is also possible.

Figure 4:
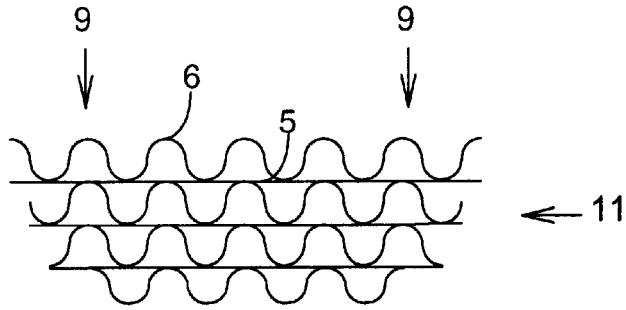
FIGS. 4, 5, 6, 7 and 8 are cross-sectional views of different forms of stacks of at least partially structured layers of sheet metal.

In FIGS. 4, 5, 6, 7 and 8 different initial shapes for the honeycomb body 4 to be integrated into the silencer housing 3 are shown, as a selection of the shapes which are possible as a whole. FIG. 4 shows a trapezoidal sheet metal stack 11, of smooth sheet metal layers 5 and corrugated sheet metal layers 6. In the stack 11, it is precisely those sheet metal layers having ends which have further to go to reach the part seam after assembly, that are longer in the lateral ends 9 of the sheet metal stack. In this way it is ensured that the ends of practically all of the sheet metal layers can be securely retained.

Figure 5:
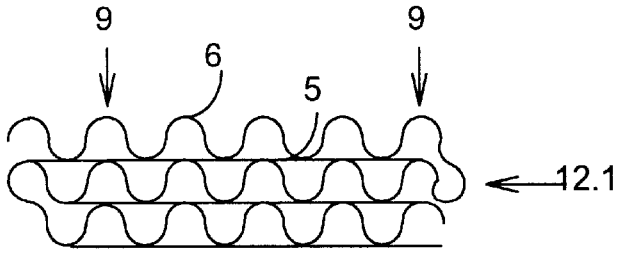

FIG. 5 shows a meander-shaped or wave-form sheet metal stack 12.1, in which a corrugated layer of sheet metal 6 is layered in a meander-shape or wave-form, and individual smooth sheet metal layers 5 are disposed between the individual corrugated layers.

Figure 6:
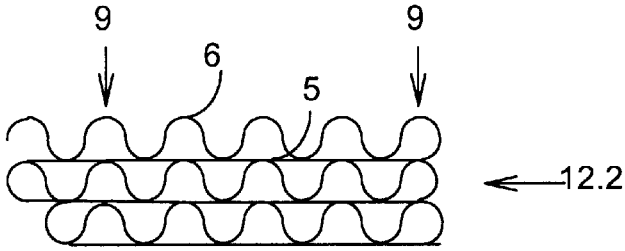

A similar configuration is shown in FIG. 6, wherein in this case, only a single sheet metal layer which is smooth and corrugated in sections, has been layered to form a wave-form or meander-shaped sheet metal stack 12.2.

Figure 7:
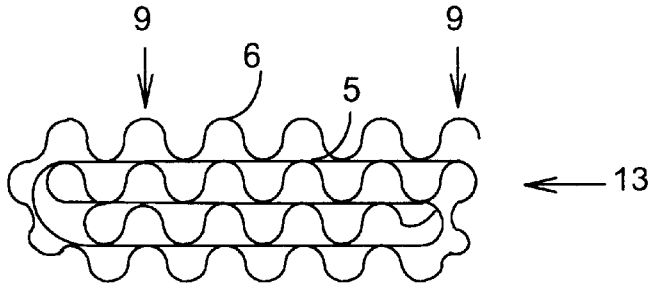

FIG. 7 shows an oval sheet metal stack 13 made from a smooth sheet metal layer 5 and a corrugated sheet metal layer 6 as an initial stack. Such a stack can be obtained in a conventional manner by pressing flat a spiral sheet metal stack wound with a cylindrical cavity.

Figure 8:
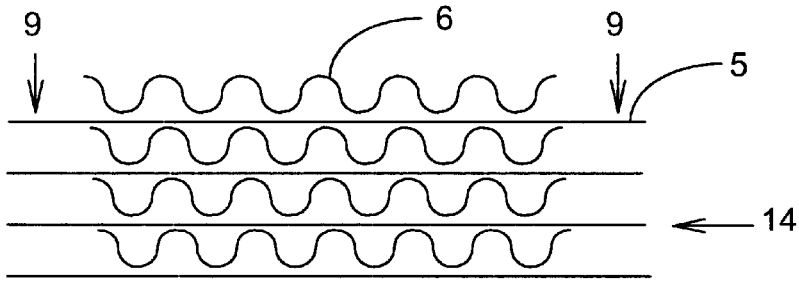

FIG. 8 lastly shows a particularly preferred embodiment, in which only the smooth sheet metal layers 5 are included in the joining by the part seam. For this reason, the ends of the smooth sheet metal layers project by different amounts, corresponding to their distance from the part seam. The corrugated sheet metal layers 6 are shorter and their respective lengths are matched to the cross-sectional shape of the silencer housing, again with a certain excess volume which is later reduced by plastic deformation. In order to prevent slipping of the corrugated sheet metal layers 6 in the completed honeycomb body, in the direction of gas flow, the smooth sheet metal layers 5 and the corrugated sheet metal layers 6 are provided with structures engaging with one another in a form-locking manner. Microstructures running transversely to the direction of flow, such as are known in the prior art, are particularly suitable for this purpose. A form-locking connection is one which connects two elements together due to the shape of the elements themselves, as opposed to a force-locking connection, which locks the elements together by force external to the elements.

The present invention provides, with inexpensive manufacturing techniques, the possibility of being able to employ exhaust gas catalytic converters on a wider basis, even for small engines, for relief of the environment and the personnel operating the small engines.

We claim:

1. A catalytic converter integrated with a silencer for an engine having a capacity of less than 250 cc, comprising:

a silencer housing having a volume disposed in proximity to an engine having a capacity of less than 250 cc emitting exhaust gas, said volume including a partial volume;

a separating wall arranged in said silencer housing to separate said partial volume;

a honeycomb body disposed in said partial volume of said silencer housing for causing at least a predominant portion of the exhaust gas of the engine to flow through said honeycomb body;

said honeycomb body coated with catalytically active material;

said honeycomb body having a layered, wound or folded stack of at least partly structured sheet metal layers defining channels for passage of the exhaust gas; and said sheet metal layers of said stack squeezed between said silencer housing and said separating wall for plastically deforming at least 10% of said channels and completely filling said partial volume of said silencer housing with said honeycomb body.

2. The catalytic converter according to claim 1, wherein 20 to 30% of said channels are plastically deformed.

3. The catalytic converter according to claim 1, wherein said channels are partly elastically distorted, causing said honeycomb body to remain pre-tensioned for preventing loosening of said sheet metal layers under all operating conditions including varying thermal stresses.

4. The catalytic converter according to claim 1, wherein said channels have a certain deformation because said stack has a shape matching a shape of said partial volume of said silencer housing to be filled before insertion of said stack in said silencer housing, and said stack has a volume at least 5% greater than said partial volume of said silencer housing to be filled before insertion of said stack in said silencer housing.

5. The catalytic converter according to claim 1, wherein said channels have a certain deformation after insertion of said stack in said silencer housing because said stack has a rectangular cross-section before insertion in said silencer housing.

6. The catalytic converter according to claim 1, wherein said channels have a certain deformation after insertion of said stack in said silencer housing because said stack has a trapezoidal cross-section before insertion in said silencer housing.

7. The catalytic converter according to claim 1, wherein said channels have a certain deformation after insertion of said stack in said silencer housing because said stack has an oval cross-section before insertion in said silencer housing.

8. The catalytic converter according to claim 1, wherein said at least partly structured layers of sheet metal of said stack are individual layers having ends squeezed together and fixed onto said silencer housing.

9. The catalytic converter according to claim 8, wherein said silencer housing has two parts, and said ends are clamped in a seam between said parts.

10. The catalytic converter according to claim 1, wherein said at least partly structured sheet metal layers of said stack are formed from at least one at least partly structured, meander-shaped or oval wound metal sheet, and said stack has lateral ends each squeezed together and fixed to said silencer housing.

11. The catalytic converter according to claim 10, wherein said silencer housing has two parts, and said lateral ends are clamped in a seam between said parts.

* * * * *